United States Patent [19]

Manno et al.

[11] Patent Number: 4,965,639

[45] Date of Patent: Oct. 23, 1990

[54] TONER SUPPLY CARTRIDGE FOR REPRODUCTION AND PRINTING MACHINES

[75] Inventors: Eugene Manno, Ontario; Joseph G. Mestnik, Rochester, both of N.Y.

[73] Assignee: Xerox Corporation, Stamford, Conn.

[21] Appl. No.: 426,348

[22] Filed: Oct. 25, 1989

[51] Int. Cl.[5] ..... G03G 15/08

[52] U.S. Cl. ..... 355/260; 222/DIG. 1; 118/653

[58] Field of Search ..... 355/245, 260; 222/DIG. 1; 118/653, 656–658

[56] References Cited

U.S. PATENT DOCUMENTS

| | | | |
|---|---|---|---|
| 3,337,072 | 8/1967 | DelVecchio et al. | 214/304 |
| 3,339,807 | 9/1967 | Eichorn | 222/171 |
| 4,456,154 | 6/1984 | Herriman | 222/DIG. 1 |
| 4,611,730 | 9/1986 | Ikesue et al. | 222/DIG. 1 |
| 4,688,926 | 8/1987 | Manno | 355/3 |
| 4,739,907 | 4/1988 | Gallant | 222/DIG. 1 |
| 4,784,081 | 11/1988 | Knott | 222/DIG. 1 |

OTHER PUBLICATIONS

Xerox Disclosure Journal, Tannascoli et al., Nov./Dec. 1988, vol. 13, No. 6, p. 311.

*Primary Examiner*—R. L. Moses

[57] ABSTRACT

A reproduction machine having a rotatable toner supply cartridge which dispenses toner into a developer sump, the cartridge being inclined at an angle with respect to the horizontal axis so as to dispense toner, assisted by gravity in controlled amounts only from the end of the cartridge extending beneath the horizontal.

2 Claims, 2 Drawing Sheets

TONER SUPPLY CARTRIDGE FOR REPRODUCTION AND PRINTING MACHINES

BACKGROUND AND INFORMATION DISCLOSURE STATEMENT

The invention relates to reproduction machines, and more particularly, to an improved system for supplying fresh or makeup toner to reproduction machines.

In xerographic type reproduction machines, latent electrostatic images of the item being copied or printed are generated on a moving recording member such as a photoreceptor through exposure to the document being copied or in accordance with an image signal input. Prior to exposure, the recording member is first readied as by charging. Following exposure, the latent electrostatic images on the recording member are developed at a developing station which in typical present day practice, comprises one or more magnetic brushes for bringing a developer, usually a mixture of carrier beads and toner, into developing relation with the recording member and the image thereon. Following this, the developed image is transferred at a transfer station to a copy substrate material such as a sheet of paper. After transfer, leftover developer is removed from the recording member while the developed image previously transferred to the copy substrate material is fixed as by fusing to provide a permanent copy or reproduction.

In the course of developing images as described above, the toner portion of the developer mixture is depleted and to maintain the necessary proportion of toner, fresh toner must be added from time to time. Since machines of this type are normally capable of processing several different size images up to a preset maximum, toner depletion may not be uniform across the width of the developer sump.

Various types of toner re-supply systems are known to the prior art as, for example, the canister or cartridge type shown by U.S. Pat. No. 3,337,072 (Del Vecchio et al.). In the Del Vecchio et al. prior art arrangement, a toner supply canister consisting of relatively rotatable inner and outer concentric tubes, each with a toner dispensing opening are used. The supply of fresh toner is held in the inner tube, and by rotating the inner tube relative to the outer tube, the toner dispensing openings in each are brought into alignment. Another toner dispensing system is shown by U.S. Pat. No. 3,339,807 (Eichorn). There, the toner supply canister, once mounted, rotates to bring the toner dispensing holes opposite a series of openings in a stationary grid. Preparatory to this, a tear away strip, which seals the holes during shipment is first removed.

In U.S. Pat. No. 4,688,926, a toner dispensing arrangement is disclosed in which toner is ejected from a rotating cartridge by a toner ejecting rod/cam drive assembly.

The present invention is intended to provide a simple, inexpensive alternative to the above toner dispensing cartridges. Instead of the typical horizontal orientation of the toner dispenser vis-a-vis, the developer housing, the dispensing cartridge is inclined at a small angle to the horizontal and is constantly rotated. Toner is, therefore, dispensed only at the end which extends beneath the horizontal. Gravity thus assists the dispensing operation. Instead of the prior art series of dispensing ports required to be arranged along the entire length of the cartridge, the present invention requires that only a few toner dispensing ports need be formed at the dispensing end (the end beneath the horizontal). More particularly, the invention relates to a copying/printing machine having a movable recording member on which latent electrostatic images are created, developing means for developing said images with toner, and transfer means for transferring the developed images to a copy substrate material, said developing means including a developer housing adjacent said recording member with means in said housing to bring developer from said housing into developing relation with said recording member to develop images on said recording member, the combination of: a tube-like cylinder adapted to contain a supply of fresh toner; means supporting said cylinder in spaced relation above said sump, the axis of said cylinder being at an angle with respect to the horizontal; drive means for continually rotating said cylinder, said cylinder having a plurality of toner discharge openings located at the end of the cartridge lying beneath the horizontal, and means for mixing said toner dispensed into said developer housing said mixing means further adapted to transfer the mixed developer onto said developing means.

IN THE DRAWINGS

DESCRIPTION OF THE INVENTION

Figure 1:
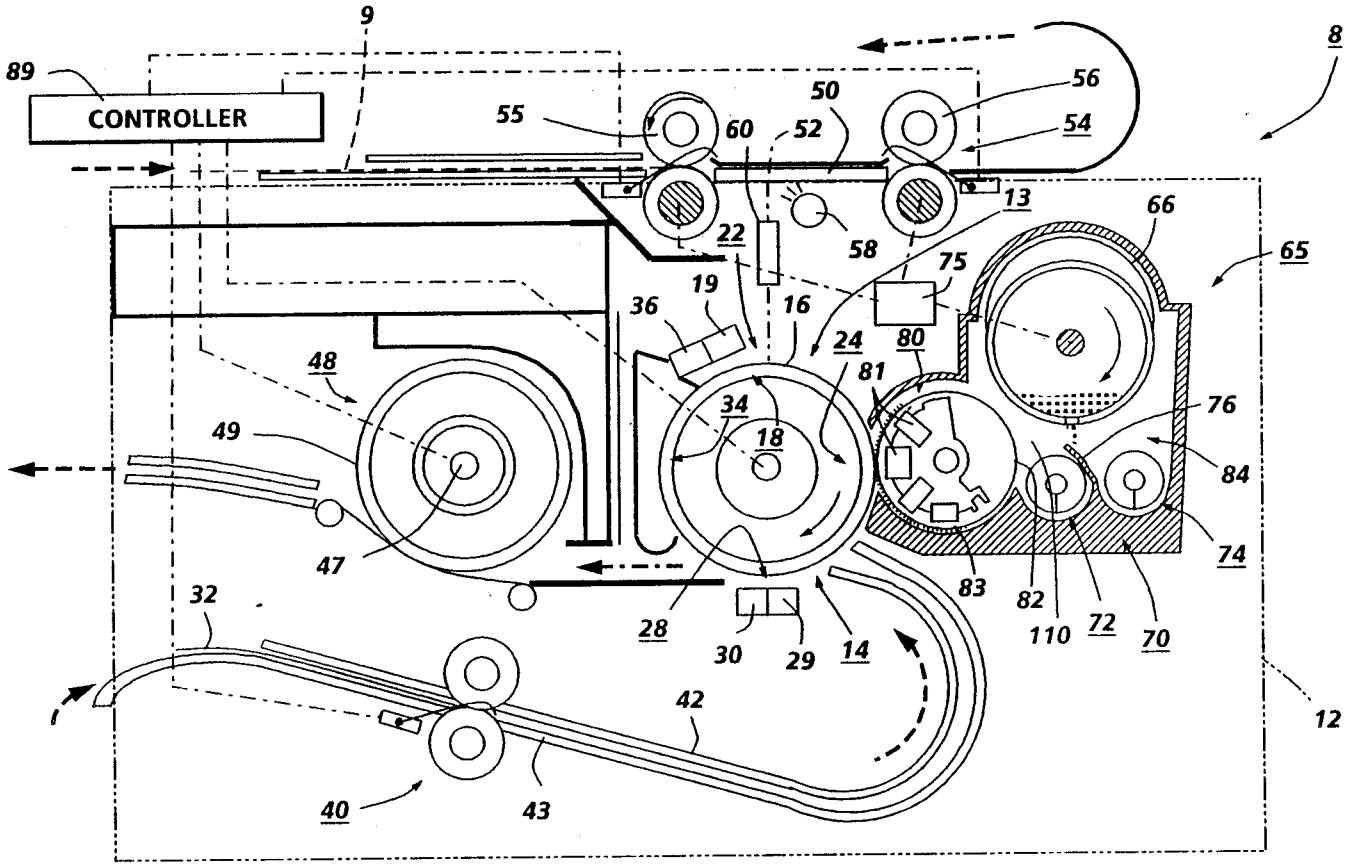
FIG. 1 is a side schematic view in section of a reproduction machine incorporating the toner dispensing cartridge of the present invention.

Referring to FIG. 1 of the drawings, there is shown a xerographic type reproduction machine 8 incorporating the toner supply cartridge assembly of the present invention, designated generally by the numeral 65. Machine 8 has a suitable frame 12 on which the machine xerographic components are operatively supported. Briefly, and as will be familiar to those skilled in the art, the machine xerographic components include a recording member, shown here in the form of a rotatable photoreceptor 14. In the exemplary arrangement shown, photoreceptor 14 comprises a drum having a photoconductive surface 16. Operatively disposed about the periphery of photoreceptor 14 are charge station 18 with charge corotron 19 for placing a uniform charge on the photoconductive surface 16 of photoreceptor 14; exposure station 22 where the previously charged photoconductive surface 16 is exposed to image rays of the document 9 being copied or reproduced; development station 24 where the latent electrostatic image created on the photoconductive surface 16 is developed by toner; transfer detack station 28 with transfer corotron 29 and detack corotron 30 for transferring the developed image to a suitable copy substrate material such as a copy sheet 32 brought forward in timed relation with the developed image on photoconductive surface 16, and cleaning station 34 with a cleaning blade and discharge corotron 36.

Copy sheets 32 are brought forward to transfer station 28 by feed roll pair 40, sheet guides 42, 43 serving to guide the sheet through an approximately 180° turn prior to transfer station 28. Following transfer, the sheet 32 is carried forward to a fusing station 48 where the transferred toner image is fixed by fusing roll 49. Fusing roll 49 is heated by a suitable heater such as lamp 47 disposed within the interior of roll 49. After fixing, the copy sheet 32 is discharged.

A transparent platen 50 supports the document 9 as the document is moved past a scan point 52 by a constant velocity type transport 54. As will be understood, scan point 52 is in effect a scan line extending across the width of platen 50 at a desired point along platen 50 where the document is scanned line by line as the document is moved along platen 50 by transport 54. Transport 54 has input and output document feed roll pairs 55, 56, respectively, on each side of scan point 52 for moving document 9 across platen 50 at a predetermined speed. Exposure lamp 58 is provided to illuminate a strip-like area of platen 50 at scan point 52. The image rays from the document line scanned are transmitted by a gradient index fiber lens array 60 to exposure station 22 to expose the photoconductive surface 16 of the moving photoreceptor 14.

In the upper part of the assembly 65, a toner dispensing cartridge 66 is rotatably mounted at a slight angle with respect to the horizontal so as to dispense toner particles downward into a sump area occupied by a dual auger mixing assembly 70 which includes a pair of rotatably mounted augers 72, 74 separated by a baffle 76. The cartridge 66 is continually rotated by means of a drive motor 75.

Continuing with the description of the developing station 24, a magnetic brush developer roll 80 is disposed in predetermined operative relation to the photoconductive surface 16 of photoreceptor 14 in developer housing 65, the length of developing roll 80 being equal to or slightly greater than the width of photoconductive surface 16, with the axis of roll 80 paralleling the axis of photoreceptor 14. Developer roll 80 has a plurality of stationary magnet assemblies 81 disposed within a rotatable cylinder or sleeve 82 being rotatably journaled for rotation on the opposing sides of developer housing 65. Magnet assemblies 81 are arranged so that as the sleeve 82 rotates, developer is attracted to the exterior surface of the sleeve to form a brush-like covering 83. Rotation of the sleeve 82 carries a developer brush 83 into developing relation with the photoconductive surface 16 of photoreceptor 14 to develop the latent electrostatic image therein.

Figure 2:
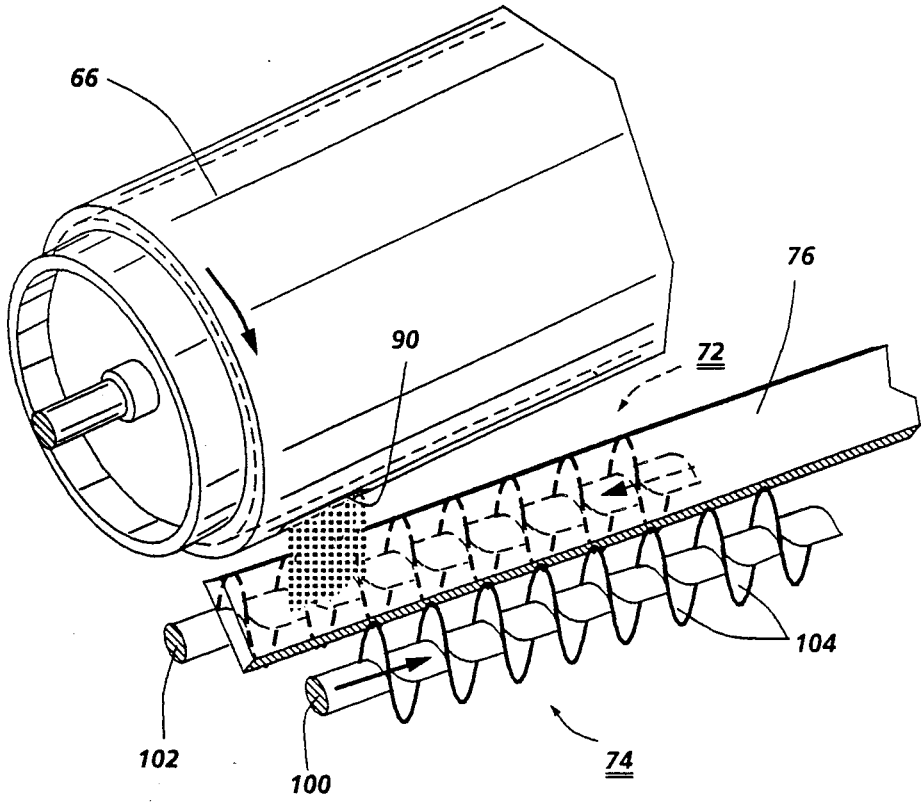
FIG. 2 is a partial isometric side view showing the machine developer section.
Figure 3:
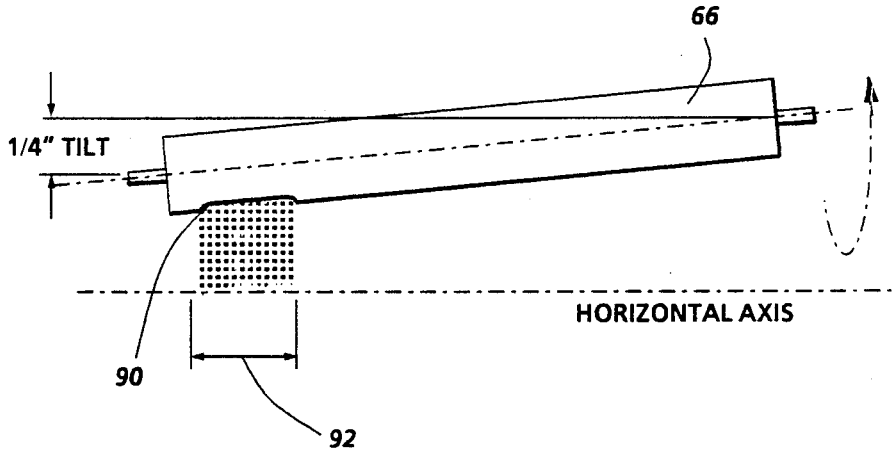
FIG. 3 is a side view of the toner dispensing cartridge.

Turning now to a more detailed description of the developer station 24, and particularly the toner dispenser 66, FIG. 2 shows a partial isometric side section view of the toner dispensing and mixing portion of the station, and FIG. 3 shows a side view of the toner dispenser cartridge. Toner dispenser cartridge 66 is rotatably supported in appropriate bearing journals in the opposing sides of developer housing 65. The cartridge is adapted to be constantly rotated so as to dispense fresh toner through discharge ports 90.

According to a first feature of the invention, cartridge 66, as shown in FIG. 3, is inclined approximately 0.4° to the horizontal. The toner within the cartridge is thus concentrated within the end extending beneath the horizontal axis, and is gravity fed through ports 90 as each of the ports are rotated through the 6 o'clock position. According to a second feature of the invention, ports 90 extend only along a portion of the length of the cartridge since the toner dispensing now occurs only along the end of the cartridge extending below the horizontal. The toner dispensing, assisted by gravity, falls wholly within a dispense zone 92 shown schematically in FIG. 3. One end of auger 74 lies within the dispensing zone.

Auger 74, having arcuate segments 104, is mounted on shaft 100 which is supported in appropriate end journals located in the side of the developer housing. Shaft 100 is driven by motor means (not shown) in a counterclockwise direction. Auger 72 also having arcuate segments is mounted on shaft 102 also supported in end journals in the housing, and driven by appropriate motor means in a clockwise direction. Both augers are elongated and have a length approximately equal to the length of the brush roll 80. Baffle 76 is connected at its base to a semi-cylindrical base portion of housing 65 which accommodates the dual auger mounting. The baffle is angled at its top portion towards auger 72 allowing a fairly large area 84 overlying auger 74 to be filled by toner dispensed from cartridge 66. Baffle 76 is further characterized as having a length which is shorter than the length of augers 72, 74. The baffle thus functions to prevent toner from being transferred between augers along the central portion, but allows inter-auger toner transfer at both ends.

A suitable controller 89 (FIG. 1) is provided for operating the various components of machine 8 in the predetermined timed relation with one another to produce copies. In operation, machine 8 is actuated by a suitable start control button. The document to be copied is then inserted into the nip of document transport roll pair 55 which carries the document forward across platen 50. As the leading edge of the document reaches a detector controller 89 in response to the signal from a detector, starts feed roll pair 40 to advance the copy sheet 32 forward in timed relation with the document 9 as the document is transported across platen 50 and past scan point 52 by document transport 54. The document image developed on the photoconductive surface 16 of photoreceptor 14 is transferred to copy sheet 32 as the copy sheet moves through transfer station 28. Following transfer, the copy sheet 32 passes to fusing station 48 where the image is fixed.

As toner images are formed and toner depleted, fresh toner is dispensed through holes 90 as dispenser cartridge 66 rotates. Auger 74 continually mixes the fresh toner with the denuded carrier particles and existing toner. As the auger 74 rotates in a counterclockwise direction, and with arcuate segments 104 having a orientation as shown, the mixture is conveyed from right to left in FIG. 3, and into the page in FIG. 2. The mixture transfers into auger 72 and auger 72, rotating in the clockwise direction, effectively forms a sump area 110 (FIG. 1) extending along the length of the auger and of developing roll 80. The toner mixture is then rotatably and axially circulated by auger 72 in close proximity to roll 80. As the roll, or more properly, the sleeve 82 rotates, the toner mixture is distributed to the exterior surface of sleeve 82 to form toner brush 83 which is then rotated into the development zone to form the developed image.

It has been found that an optimum tilt angle for the toner dispenser is 0.4° to the horizontal, but satisfactory results can be obtained within a tilt angle range of 0.4° to 1.0°. While one port 90 with an opening of $4 \times 8$ mm have been found to provide effective dispensing, other ports in differing diameter sizes may be preferred, but according to the invention, they are all formed in the end of the tube extending below the horizontal.

While the invention has been described with reference to the structure disclosed, it is not confined to the specific details set forth, but is intended to cover such modifications or changes as may come within the scope of the following claims:

We claim:

1. In a copying/printing machine having a movable recording member on which latent electrostatic images are created, developing means for developing said images with toner, and transfer means for transferring the developed images to a copy substrate material, said developing means including a developer housing adjacent said recording member with means in said housing to bring developer from a sump in said housing into developing relation with said recording member to develop images on said recording member, the combination of:

(a) a tube-like cylinder adapted to contain a supply of fresh toner;

(b) means supporting said cylinder in spaced relation above said sump, the axis of said cylinder being at an angle with respect to the horizontal;

(c) drive means for rotating said cylinder;

(d) said cylinder having a plurality of toner discharge ports extending only along a portion of the length of the cartridge lying beneath the horizontal, and (e) means for mixing said toner dispensed into said developer housing, said means further adapted to transfer the mixed developer onto said developing means.

2. The machine of claim 1 wherein said angle is between 0.4° and 1°.

* * * * *